US008720015B2

(12) United States Patent
Sato

(10) Patent No.: US 8,720,015 B2
(45) Date of Patent: May 13, 2014

(54) SLIDE FASTENER

(75) Inventor: Hideki Sato, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/816,245

(22) PCT Filed: Aug. 11, 2010

(86) PCT No.: PCT/JP2010/063666

§ 371 (c)(1),
(2), (4) Date: Feb. 11, 2013

(87) PCT Pub. No.: WO2012/020491

PCT Pub. Date: Feb. 16, 2012

(65) Prior Publication Data

US 2013/0139365 A1 Jun. 6, 2013

(51) Int. Cl.
*A44B 19/28* (2006.01)

(52) U.S. Cl.
USPC ..... 24/427; 24/429

(58) Field of Classification Search
USPC ..... 24/415, 416, 427, 428, 436, 429
See application file for complete search history.

(56) References Cited

U.S. PATENT DOCUMENTS

| | | | | |
|---|---|---|---|---|
| 2,355,987 A | | 8/1944 | Marinsky et al. | |
| 2,438,614 A | | 3/1948 | Morin | |
| 2,575,501 A | * | 11/1951 | Ulrich | 24/404 |
| 2,596,861 A | * | 5/1952 | Meech | 24/416 |
| 2,681,490 A | | 6/1954 | Okolowicz | |
| 2,875,490 A | | 3/1959 | Sinclair | |
| 2,879,573 A | * | 3/1959 | Ulrich | 24/415 |
| 2,937,427 A | | 5/1960 | Mikulas | |
| RE25,223 E | | 8/1962 | Mikulas | |
| 3,530,549 A | * | 9/1970 | Manchester, Jr | 24/404 |
| 3,818,549 A | | 6/1974 | Moertel | |
| 3,872,551 A | | 3/1975 | Moertel | |
| 3,872,553 A | * | 3/1975 | Moertel | 24/428 |

(Continued)

FOREIGN PATENT DOCUMENTS

| | | |
|---|---|---|
| AR | 201563 A | 3/1975 |
| BE | 804992 A | 1/1974 |

(Continued)

OTHER PUBLICATIONS

International Search Report, PCT Application No. PCT/JP2010/063666, mailed Nov. 16, 2010.

(Continued)

*Primary Examiner* — Robert J Sandy
*Assistant Examiner* — Abigail Morrell
(74) *Attorney, Agent, or Firm* — Kilpatrick Townsend & Stockton LLP

(57) ABSTRACT

There is provided a slide fastener that includes a pair of fastener stringers provided with fastener element rows having a plurality of fastener elements along opposing tape-side edges of fastener tapes, and a slider slidably attached to the fastener element rows to engage an disengage the fastener elements. One of the fastener stringers is separated from the slider when a lateral pulling force directed outward in a width direction of the fastener tapes is applied to the pair of fastener stringers. Inner surfaces of the upper and lower flanges at one side of the body in the width direction, are formed as inclined surfaces in which thicknesses of the inclined surfaces gradually increase as the inclined surfaces extend from an inside to an outside in the width direction.

4 Claims, 14 Drawing Sheets

(56) References Cited

U.S. PATENT DOCUMENTS

| | | | | |
|---|---|---|---|---|
| 4,129,928 | A | 12/1978 | Sugiyama et al. | |
| 4,409,705 | A * | 10/1983 | Yuunaga | 24/415 |
| 4,521,942 | A | 6/1985 | Oda | |
| 4,562,622 | A * | 1/1986 | Takabatake | 24/427 |
| 4,590,648 | A | 5/1986 | Yoshida et al. | |
| 5,007,144 | A | 4/1991 | Terada et al. | |
| 5,528,802 | A | 6/1996 | Akashi | |
| 5,664,300 | A | 9/1997 | Mizuno | |
| 5,898,979 | A | 5/1999 | Hamada | |
| 6,481,068 | B1 | 11/2002 | Takasawa | |
| 6,530,132 | B2 * | 3/2003 | Yamagishi et al. | 24/427 |
| 6,775,885 | B1 | 8/2004 | Wang | |
| 7,802,347 | B2 * | 9/2010 | Tachi et al. | 24/427 |
| 2002/0038496 | A1 | 4/2002 | Yamagishi et al. | |
| 2004/0055119 | A1 | 3/2004 | Keyaki et al. | |
| 2008/0034559 | A1 | 2/2008 | Tachi et al. | |
| 2009/0049659 | A1 | 2/2009 | Takani et al. | |
| 2013/0139362 | A1 | 6/2013 | Sato | |
| 2013/0139363 | A1 | 6/2013 | Sato | |
| 2013/0139364 | A1 | 6/2013 | Sato | |

FOREIGN PATENT DOCUMENTS

| | | | |
|---|---|---|---|
| CH | 559524 | A | 3/1975 |
| CN | 1290502 | A | 4/2001 |
| CN | 1493234 | A | 5/2004 |
| CN | 101371725 | A | 2/2009 |
| DE | 2346962 | A | 4/1974 |
| EP | 1088491 | A2 | 4/2001 |
| EP | 1400184 | A2 | 3/2004 |
| EP | 2027789 | A2 | 2/2009 |
| FR | 2199950 | A | 4/1974 |
| GB | 1394968 | A | 5/1975 |
| GB | 2291115 | A | 1/1996 |
| JP | 37-32712 | Y1 | 12/1962 |
| JP | 49-70740 | A | 7/1974 |
| JP | 98808/1983 | A | 7/1983 |
| JP | 39011/1989 | | 3/1989 |
| JP | 8-19407 | A | 1/1996 |
| JP | 10-327911 | A | 12/1998 |
| JP | 2001-95608 | A | 4/2001 |
| JP | 2002-101917 | A | 4/2002 |
| JP | 2004-105570 | A | 4/2004 |
| JP | 2008-36280 | A | 2/2008 |
| JP | 2009-45226 | A | 3/2009 |
| KR | 10-2001-0050789 | A | 6/2001 |
| KR | 10-2004-0025822 | A | 3/2004 |
| KR | 10-2004-025822 | A | 3/2004 |
| KR | 10-2008-019703 | A | 3/2008 |
| TW | M258627 | | 3/2005 |
| WO | 2010/113275 | A1 | 10/2010 |

OTHER PUBLICATIONS

Office Action, Japanese Patent Application No. 2012-528542, mailed Nov. 12, 2013.

Office Action, Japanese Patent Application No. 2012-528544, mailed Nov. 12, 2013.

International Preliminary Report on Patentability, PCT Application No. PCT/JP2010/063666, mailed Mar. 12, 2013.

Office Action, Taiwanese Patent Application No. 100105150, mailed Jul. 8, 2013.

Office Action, Taiwanese Patent Application No. 100105151, mailed Jul. 8, 2013.

International Search Report, PCT Application No. PCT/JP2010/063664, mailed Nov. 22, 2010.

International Search Report, PCT Application No. PCT/JP2010/061061, mailed Aug. 2, 2011.

International Preliminary Report on Patentability, PCT Application No. PCT/JP2010/063664, mailed Mar. 12, 2013.

International Preliminary Report on Patentability, PCT Application No. PCT/JP2010/063665, mailed Mar. 12, 2013.

International Preliminary Report on Patentability, PCT Application No. PCT/JP2011/061061, mailed Mar. 12, 2013.

Non-Final Office Action, U.S. Appl. No. 13/816,238 , mailed Aug. 13, 2013, 11 pages.

Non-Final Office Action, U.S. Appl. No. 13/816,263 , mailed Aug. 2, 2013, 10 pages.

Non-Final Office Action, U.S. Appl. No. 13/816,335 , mailed Aug. 2, 2013, 10 pages.

International Search Report, PCT Application No. PCT/JP2010/063665, mailed Nov. 16, 2010.

* cited by examiner

SLIDE FASTENER

This application is a national stage application of PCT/JP2010/063666 which is incorporated herein by reference.

TECHNICAL FIELD

The present invention relates to a slide fastener, and more particularly, to a slide fastener, in which if a lateral pulling force is applied to a pair of fastener stringers, one of the fastener stringers is separated from a slider.

BACKGROUND ART

As is known in the related art, a slide fastener includes an upper blade having a double structure consisting of an inner plate and an outer plate, in which the outer plate is released from the inner plate by pulling down a pull tab in one side, so that one of fastener stringers is separated from a slider (e.g., see Patent Document 1).

PRIOR ART DOCUMENT

Patent Document

Patent Document 1: U.S. Pat. No. 2,681,490

SUMMARY OF INVENTION

Problems to Be Solved by Invention

In the slide fastener disclosed in Patent Document 1, since the upper blade has the double structure consisting of the inner plate and the outer plate, its construction is complicated, and thus a manufacturing cost thereof can be increased. Also, since the inner surfaces, in a width direction, of the flanges (side rail) which are respectively formed at the outer plate of the upper blade and both left and right edges of the lower blade are formed as vertical surfaces, the fastener elements are caught by the flange at the separation, so that it is difficult to separate the one of the fastener stringers from the slider.

The present invention has been made in view of the above-described problem, and an object of the present invention is to provide a slide fastener capable of easily separating one of the fastener stringers from a slider with a simple structure.

Means for Solving Problems

The above object of the present invention can be achieved by the following configuration.

(1) A slide fastener including a pair of fastener stringers provided with fastener element rows having a plurality of fastener elements along opposing tape-side edges of a pair of fastener tapes; and a slider slidably attached to the fastener element rows to engage and disengage the fastener elements, wherein one of the fastener stringers is separated from the slider when a lateral pulling force directed outward in a width direction of the fastener tapes is applied to the pair of fastener stringers, wherein the slider includes: a body having an upper blade and a lower blade which are disposed in parallel while being spaced apart from each other in an up-down direction, a guide post connecting the upper blade and the lower blade at front ends thereof, an upper flange protruding downwardly along both left and right edges of the upper blade, a lower flange protruding upwardly along both left and right edges of the lower blade, and a pull tab attachment portion provided on an upper surface of the upper blade; and a pull tab rotatably attached to the pull tab attachment portion, and inner surfaces of the upper and lower flanges at one side of the body in the width direction are formed as inclined surfaces in which thicknesses of the inclined surfaces gradually increase as the inclined surfaces extend from an inside to an outside in the width direction.

(2) The slide fastener according to the configuration of the above (1), wherein inner surfaces of the upper and lower flanges at another side of the body in the width direction respectively have vertical surfaces which extend vertical to inner surfaces of the upper blade and the lower blade in the up-down direction.

(3) The slide fastener according to the configuration of the above (1) or (2), wherein the inclined surfaces respectively have front inclined surfaces formed at a side of shoulder mouths of the body, and rear inclined surfaces formed at a side of a rear mouth of the body, and an inclined angle of the front inclined surfaces is smaller than an inclined angle of the rear inclined surfaces.

Advantageous Effects of Invention

According to the slide fastener of the present invention, the inner surfaces of the upper and lower flanges at one side of the body in the width direction are formed as inclined surfaces in which thicknesses of the inclined surfaces gradually increase as the inclined surfaces extend from an inside to an outside in the width direction, the fastener element of the separation-side fastener stringer abuts against the inclined surfaces of the upper and lower flanges, so that the lateral pulling force is efficiently transmitted to the upper blade and lower blade through the inclined surfaces. Therefore, since the gap between the upper and lower flanges is easily widened, it is possible to easily separate the separation-side fastener stringer from the slider with a simple structure.

EMBODIMENTS OF INVENTION

One embodiment of a slide fastener according to the present invention will now be described in detail with reference to the accompanying drawings. In the following description of the embodiment, as for a fastener tape, a front side refers to a near side with respect to a paper surface of FIG. 1; a back side refers to a far side with respect to the paper surface of FIG. 1; an upper side refers to an upper side with respect to the paper surface of FIG. 1; a lower side refers to a lower side with respect to the paper surface of FIG. 1; a left side refers to a left side with respect to the paper surface of FIG. 1; and a right side refers to a right side with respect to the paper surface of FIG. 1. As for a slider, an upper side refers to a near side with respect to the paper surface of FIG. 1; a lower side refers to a far side with respect to the paper surface of FIG. 1; a front side refers to an upper side with respect to the paper surface of FIG. 1; a rear side refers to a lower side with respect to the paper surface of FIG. 1; a left side refers to a left side with respect to the paper surface of FIG. 1; and a right side refers to a right side with respect to the paper surface of FIG. 1. Also, a right and left direction of the fastener tapes and the slider is referred to as a width direction, and an up-down direction of the fastener tapes is referred to as a longitudinal direction.

Figure 1:
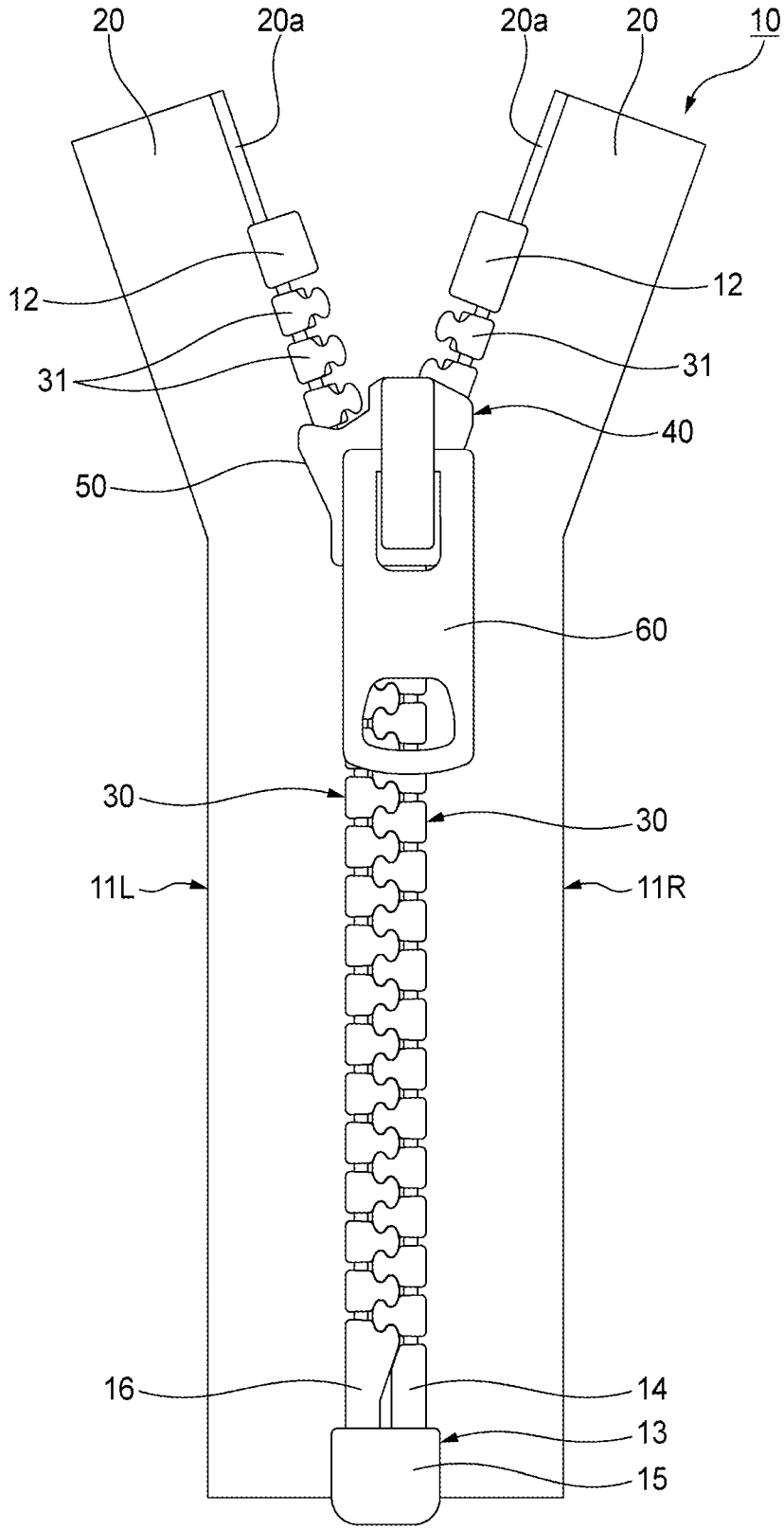
FIG. 1 is a front view of a slide fastener according to one embodiment of the present invention.
Figure 6:
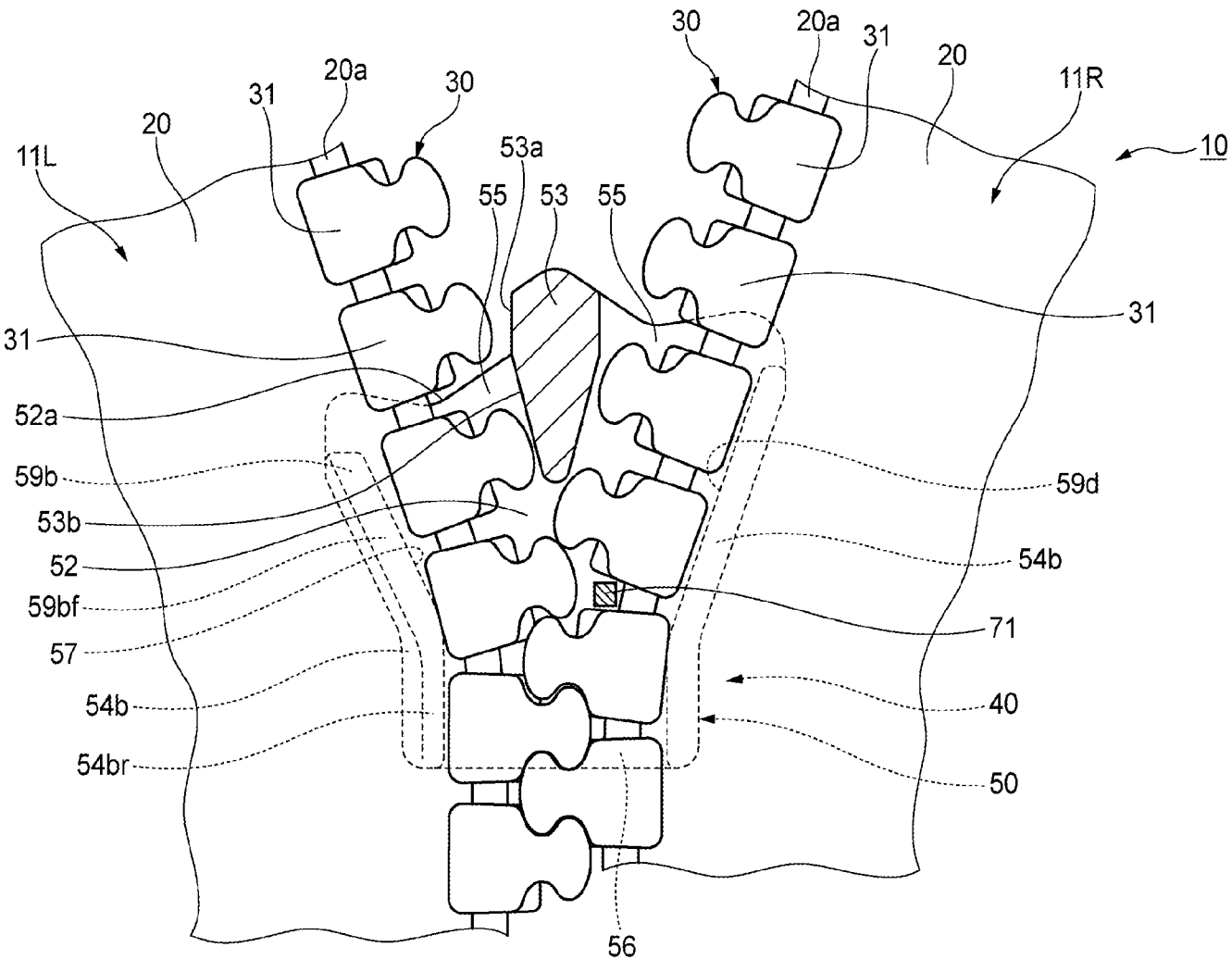
FIG. 6 is an enlarged front view of the slide fastener in which an upper blade is cut away.

As illustrated in FIGS. 1 and 6, a slide fastener 10 of this embodiment includes a pair of left and right fastener stringers 11L and 11R in which fastener element rows 30 having a plurality of fastener elements 31 are provided along opposing tape-side edges 20*a* of a pair of left and right fastener tapes 20, a slider 40 slidably attached to the fastener element rows 30 to engage and disengage the fastener elements 31, top end stops 12 each attached to upper end portions of the tape-side edges 20*a* of the pair of left and right fastener tapes 20, and separable end stop 13 formed at lower end portions of the tape-side edges 20*a* of the pair of left and right fastener tapes 20.

The separable end stop 13 includes a box pin 14 and a box body 15 which are formed at lower end portions of the tape-side edge 20*a* of the right fastener tape 20, and an insert pin 16 which is formed at the lower end portion of the tape-side edge 20*a* of the left fastener tape 20 and is able to be inserted into the box body 15. Also, in this embodiment, the left fastener stringer 11L provided with the insert pin 16 is a separation-side fastener stringer which is able to be detached from the slider 40, while the right fastener stringer 11R provided with the box pin 14 and the box body 15 is a stationary-side fastener stringer which is not able to be detached from the slider 40.

The fastener element rows 30 are comprised of the plurality of fastener elements 31 which are formed on the tape-side edges 20*a* of the fastener tapes 20 with injection molding using synthetic resin, for example, polyamide, polyacetal, polypropylene, or polybutylene terephthalate.

The slider 40 is a slider having an automatic stop function, as illustrated in FIGS. 2 to 6, and includes a body 50, a pull tab 60, a stopper claw body 70, and a pull tab holding cover 80.

The body 50 has an upper blade 51 and a lower blade 52 which are disposed in parallel while being spaced apart from each other in an up-down direction, a guide post 53 connecting the upper blade 51 and the lower blade 52 at front ends thereof and at a center portion in a width direction, upper flanges 54*a* protruding downward from both left and right edges of the upper blade 51, and lower flanges 54*b* protruding upward from both left and right edges of the lower blade 52. Accordingly, a front portion of the body 50 is provided with left and right shoulder mouths 55 which are separated by the guide post 53, and a rear portion of the body 50 is provided with a rear mouth 56. An approximately Y-shaped element guide passage 57 is formed between the upper blade 51 and the lower blade 52 to communicate the left and right shoulder mouth 55 and the rear mouth 56, and the element guide passage 57 forms a path through which the pair of left and right fastener element rows 30 are inserted.

Figure 4:
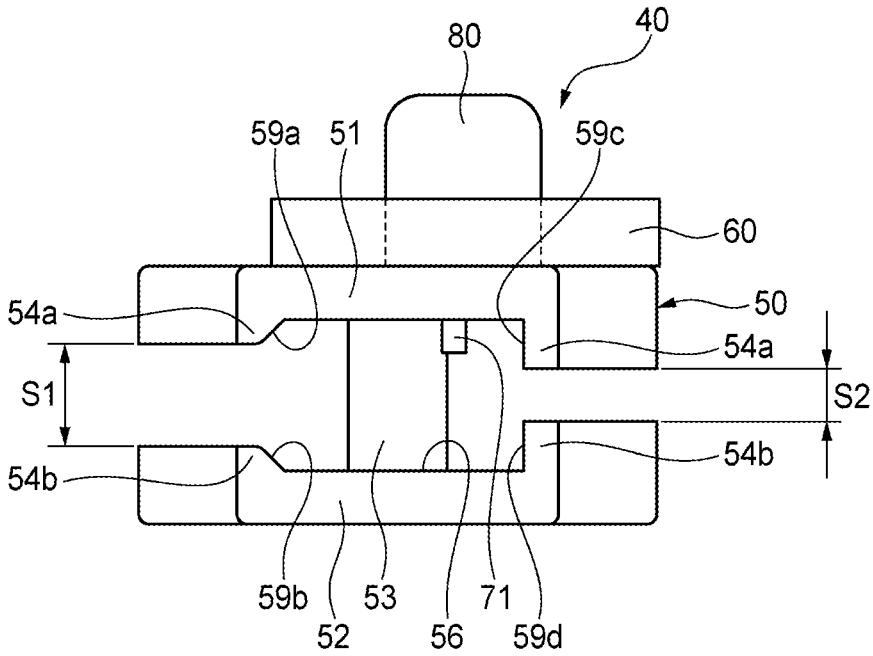
FIG. 4 is a rear view of the slider shown in FIG. 2, when seen from a rear mouth.

As illustrated in FIG. 4, a dimension S1 of a gap between the upper and lower flanges 54*a* and 54*b* at the left side of the body 50 in the up-down direction is set to be larger than a dimension S2 of a gap between the upper and lower flanges 54*a* and 54*b* at the right side in the up-down direction. Accordingly, the left fastener stringer 11L can be separated from the slider 40.

Figure 5:
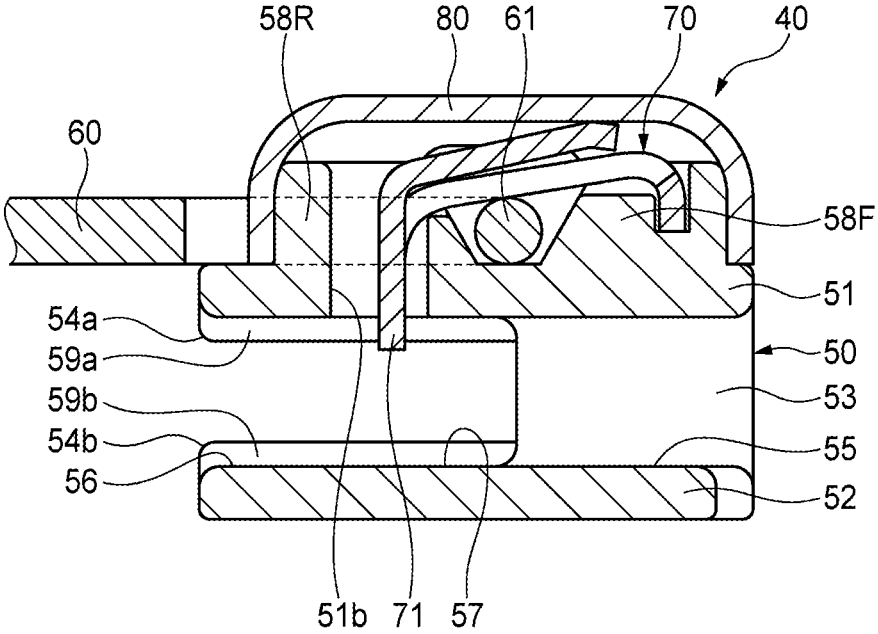
FIG. 5 is a cross-sectional view taken along the line A-A in FIG. 3.

The right side (a side of stationary-side fastener stringer 11R) of the upper surface of the upper blade 51 with respect to the guide post 53 in the width direction is provided with a front attachment post 58F and a rear attachment post 58R which are installed upright parallel with each other and arranged in a front and rear direction, to attach the pull tab holding cover 80 thereto. A link portion 61 of the pull tab 60 and the stopper claw body 70 are accommodated between the front attachment post 58F and the rear attachment post 58R, and the front attachment post 58F and the rear attachment post 58R are covered by the pull tab holding cover 80 and are fixed by crimping. Also, as illustrated in FIG. 5, the upper blade 51 is provided with a claw insertion hole 51*b* in which the a stopper claw 71 of the stopper claw body 70 is inserted. In this embodiment, a pull tab attachment portion is configured by the front attachment post 58F, the rear attachment post 58R, the stopper claw body 70, and the pull tab holding cover 80.

As described above, since the front attachment post 58F and the rear attachment post 58R are formed at the right side of the upper surface of the upper blade 51 with respect to the guide post 53 in the width direction, rigidity of the left side of the upper blade 51 with respect to the guide post 53 is slightly reduced, so that the left side of the upper blade 51 is likely to be bent. Accordingly, since the left side of the upper blade 51 can be easily bent, the separation-side fastener stringer 11L can be easily separated from the slider 40.

In addition, since the stopper claw body 70 is disposed at the right side of the upper surface of the upper blade 51 with respect to the guide post 53 in the width direction, as illustrated in FIG. 6, the stopper claw 71 of the stopper claw body 70 is inserted between the fastener elements 31 of the stationary-side fastener stringer 11R. Accordingly, since the stopper claw 71 does not contact with the fastener elements 31 of the separation-side fastener stringer 11L, it is possible to smoothly separate the separation-side fastener stringer 11L from the slider 40.

Figure 2:
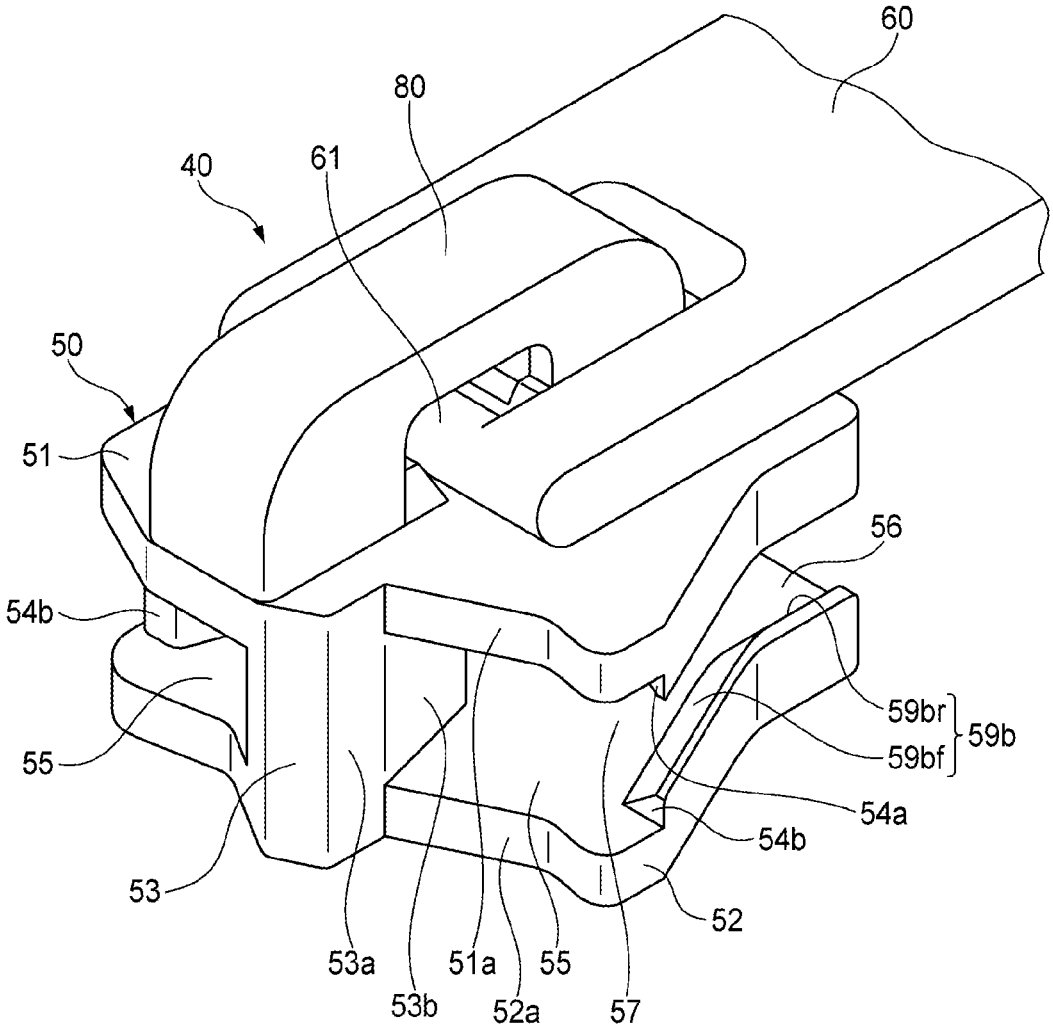
FIG. 2 is a perspective view of a slider shown in FIG. 1.
Figure 3:
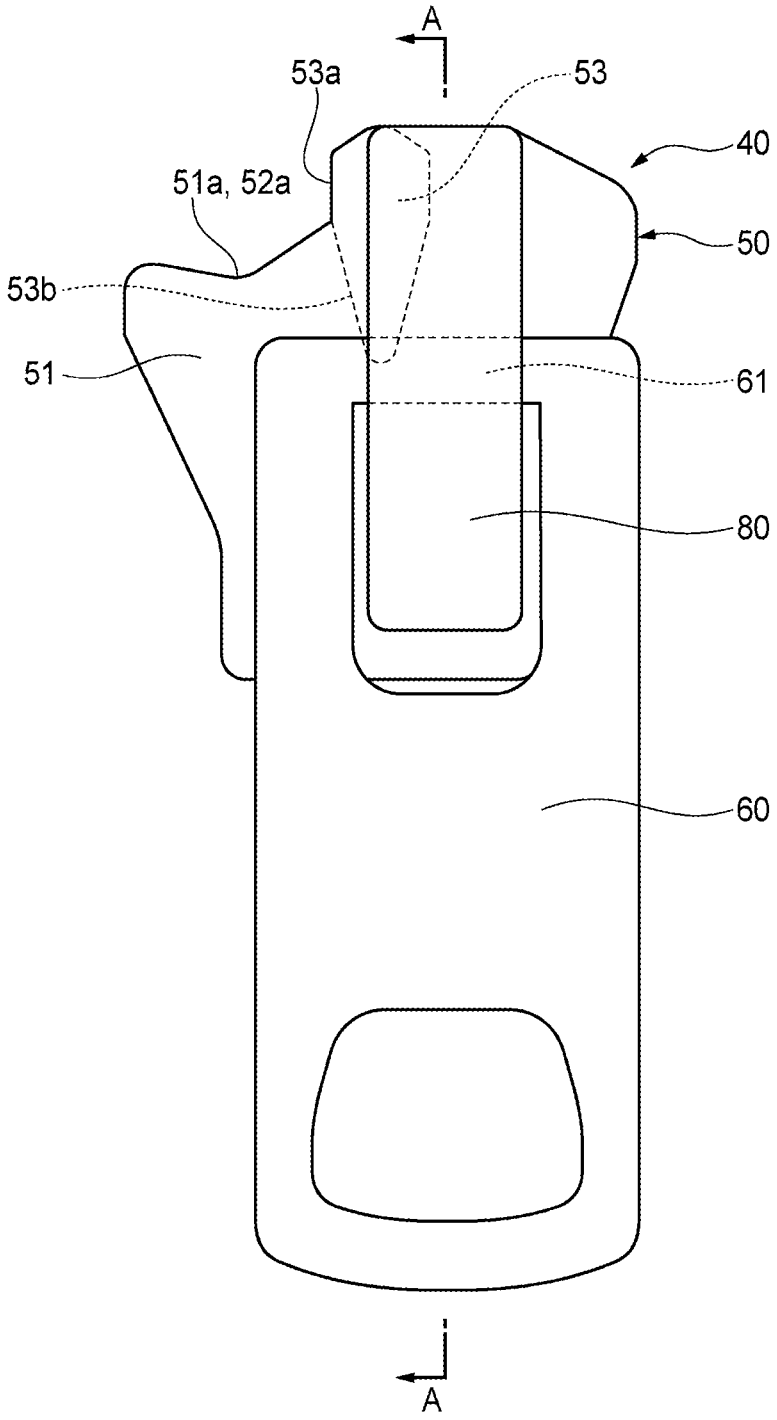
FIG. 3 is a plan view of the slider shown in FIG. 2.

As illustrated in FIGS. 2, 3 and 6, the upper blade 51 and the lower blade 52 are respectively provided with cutaway portions 51*a* and 52*a* extending outward (toward the separation-side fastener stringer 11L) in the width direction from a front lateral surface 53*a* at the left side of the guide post 53. For this reason, since a length of the upper and lower flanges 54*a* and 54*b* of the left side of the body 50 in the longitudinal direction is shorter than the upper and lower flanges 54*a* and 54*b* at the right side of the body 50, the rigidity of the left side of the upper blade 51 and the lower blade 52 with respect to the guide post 53 is slightly reduced, so that the left side of the upper blade 51 and the lower blade 52 are likely to be bent. Accordingly, since the left side of the upper blade 51 and the lower blade 52 can be easily bent, the separation-side fastener stringer 11L can be easily separated from the slider 40.

The cutaway portions 51*a* and 52*a* extend outward in the width direction and rearward in an oblique manner from a boundary between the front lateral surface 53*a* and the rear lateral surface 53*b* at the left side of the guide post 53. The cutaway portions 51*a* and 52*a* are then bent at about an intermediate portion, and obliquely extend outward in the width direction and forward in an oblique manner.

Figure 11:
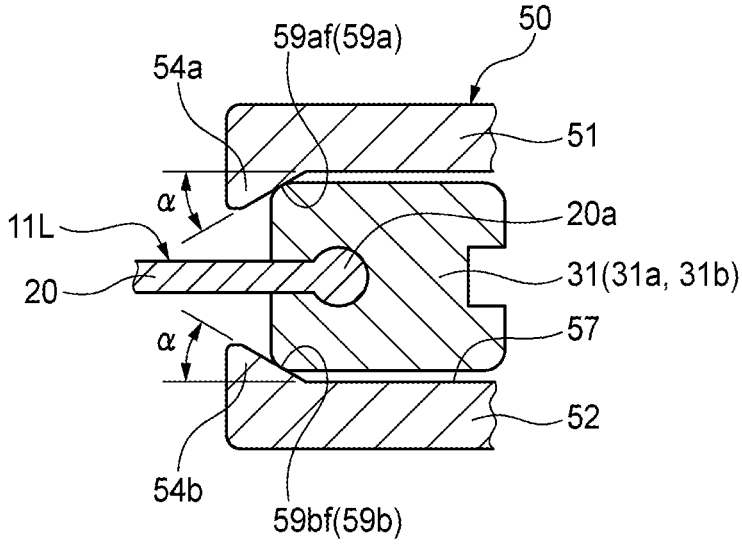
FIG. 11 is a partial cross-sectional view illustrating a state in which the element of the separation-side fastener stringer comes in contact with a front inclined surface of a flange of the slider.
Figure 14:
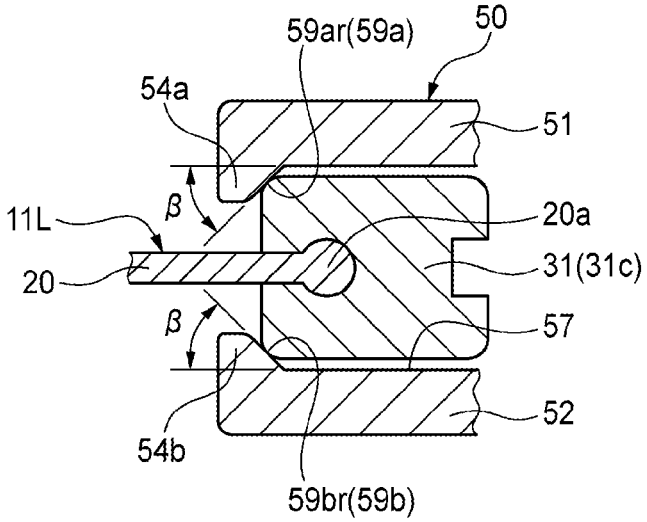
FIG. 14 is a partial cross-sectional view illustrating a state in which elements of a separation-side fastener stringer come in contact with the rear inclined surface of the flange of the slider.

As illustrated in FIGS. 2 and 4, inner surfaces of the upper and lower flanges 54*a* and 54*b* at the left side of the body 50 in the width direction are formed as inclined surfaces 59*a* and 59*b* in which thicknesses of the inclined surfaces 59*a* and 59*b* gradually increase as the inclined surfaces 59*a* and 59*b* extend from an inside to an outside in the width direction. In addition, as illustrated in FIGS. 11 and 14, the inclined surfaces 59*a* and 59*b* respectively have front inclined surfaces 59*af* and 59*bf* formed at a side of the shoulder mouths 55 of the body 50, and rear inclined surfaces 59*ar* and 59*br* formed at a side of the rear mouth 56 of the body 50. An inclined angle $\alpha$ of the front inclined surfaces 59*af* and 59*bf* is smaller than an inclined angle $\beta$ of the rear inclined surfaces 59*ar* and 59*br*. In this embodiment, the inclined angle $\alpha$ is set as 30°, while the inclined angle $\beta$ is set as 45°. In this instance, the inclined angles $\alpha$ and $\beta$ are arbitrary, if a condition of $\alpha<\beta$ is met. Preferably, the inclined angle $\alpha$ is 20 to 40°, and the inclined angle $\beta$ is 30 to 60°. The inclined angles $\alpha$ and $\beta$ may be set to be equal to form one inclined surface.

Figure 12:
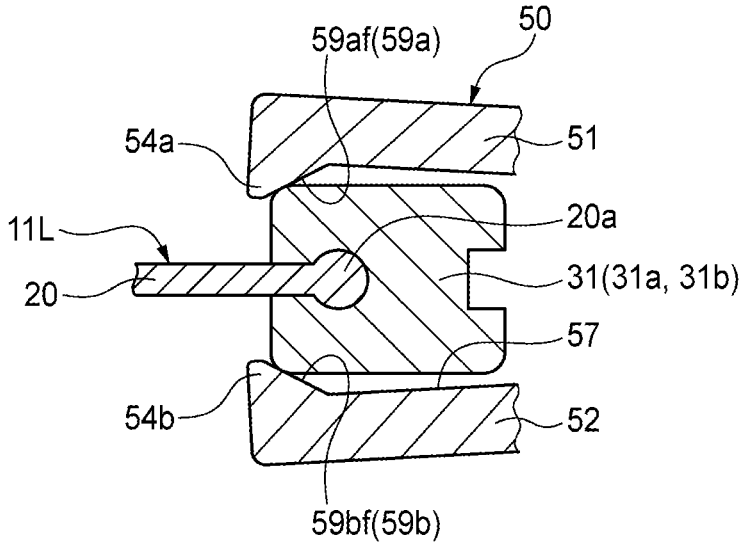
FIG. 12 is a partial cross-sectional view illustrating a state in which the element shown in FIG. 11 mounts the front inclined surface while pushing down the front inclined surface, so that a gap between the upper and lower flanges is widened.
Figure 13:
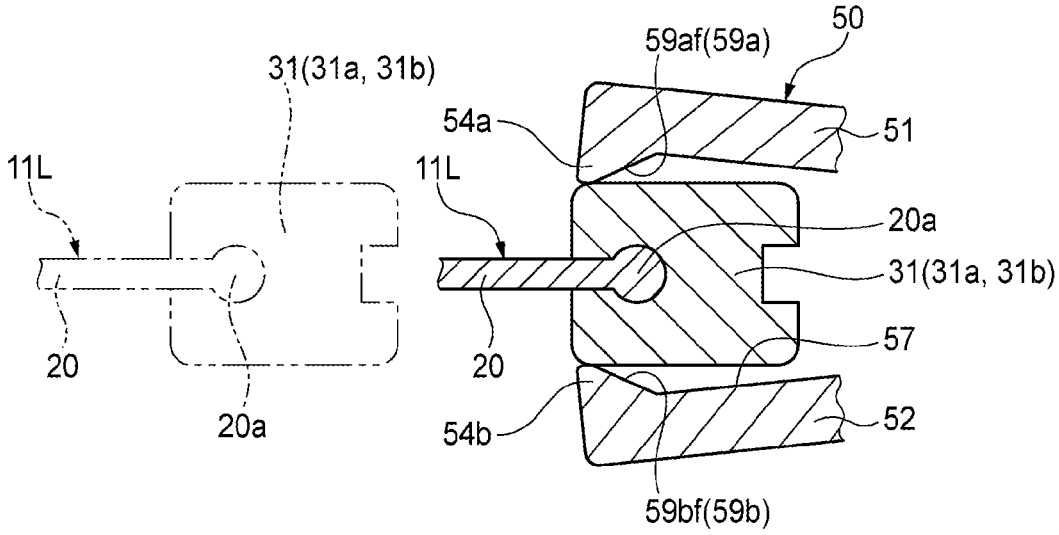
FIG. 13 is a partial cross-sectional view illustrating a state in which the element shown in FIG. 12 climbs over the front inclined surface, and then gets out of the slider.
Figure 15:
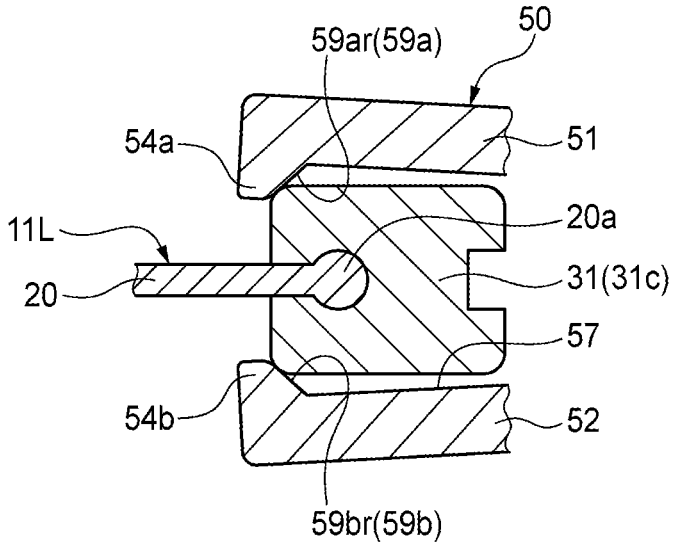
FIG. 15 is a partial cross-sectional view illustrating a state in which the element shown in FIG. 14 mounts the rear inclined surface while pushing down the rear inclined surface, so that the gap between the upper and lower flanges is widened.

For this reason, as illustrated in FIGS. 11 and 14, the upper and lower corners of the fastener element 31 of the separation-side fastener stringer 11L to which the lateral pulling force is applied respectively abut against the front inclined surfaces 59*af* and 59*bf* and the rear inclined surfaces 59*ar* and 59*br* of the upper and lower flanges 54*a* and 54*b*, the lateral pulling force is efficiently transmitted to the upper blade 51 and the lower blade 52 through the front inclined surfaces 59*af* and 59*bf* and the rear inclined surfaces 59*ar* and 59*br*. Therefore, as illustrated in FIGS. 12, 13 and 15, since a gap between the upper and lower flanges 54*a* and 54*b* is easily widened, it is possible to easily separate the separation-side fastener stringer 11L from the slider 40.

Furthermore, since the inclined angle $\alpha$ of the front inclined surfaces 59*af* and 59*bf* is smaller than the inclined angle $\beta$ of the rear inclined surfaces 59*ar* and 59*br*, the fastener elements 31 easily climb over the front inclined surfaces 59*af* and 59*bf* rather than the rear inclined surfaces 59*ar* and 59*br*. Also, since the front inclined surfaces 59*af* and 59*bf* are set as the small inclined angle $\alpha$ and the rear inclined surfaces 59*ar* and 59*br* are set as the large inclined angle b, the fastener elements 31 easily get out of the front inclined surfaces 59*af* and 59*bf*, and the fastener elements 31 hardly get out of the rear inclined surfaces 59*ar* and 59*br*. For this reason, even though a slight lateral pulling force is applied to the separation-side fastener stringer 11L, the fastener element 31 is prevented from carelessly getting out of the slider by the rear inclined surfaces 59*ar* and 59*br* of the large angle. Accordingly, a function of separating the separation-side fastener stringer 11L from the slider 40 is compatible with a function as the slide fastener.

As illustrated in FIG. 4, the inner surfaces of the upper and lower flanges 54*a* and 54*b* at the right side of the body 50 in the width direction respectively have vertical surfaces 59*c* and 59*d* which extend vertical to inner surfaces of the upper blade 51 and the lower blade 52 in the up-down direction.

Figure 7:
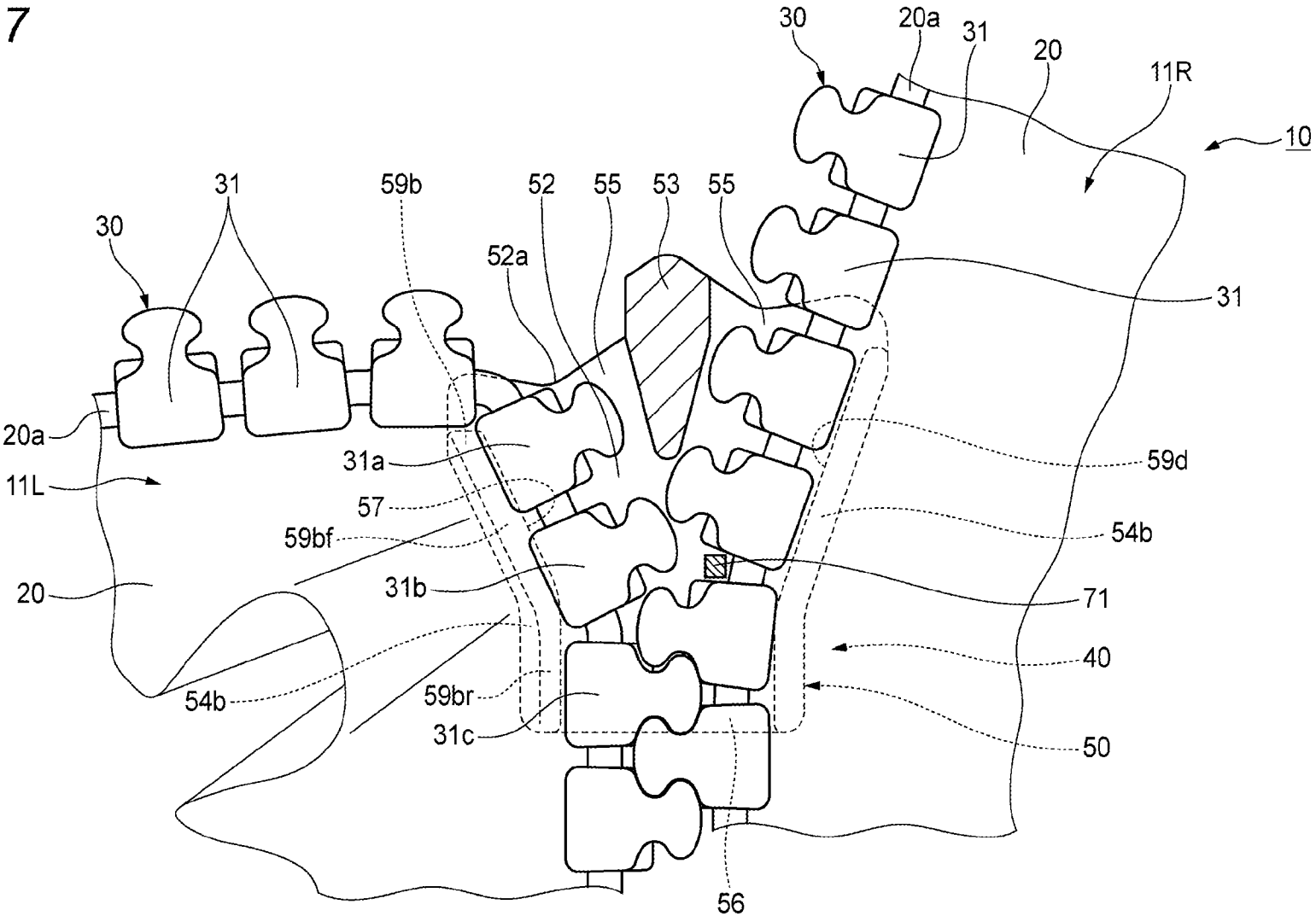
FIG. 7 is an enlarged front view illustrating a state in which a lateral pulling force is applied to the slide fastener in FIG. 6.
Figure 8:
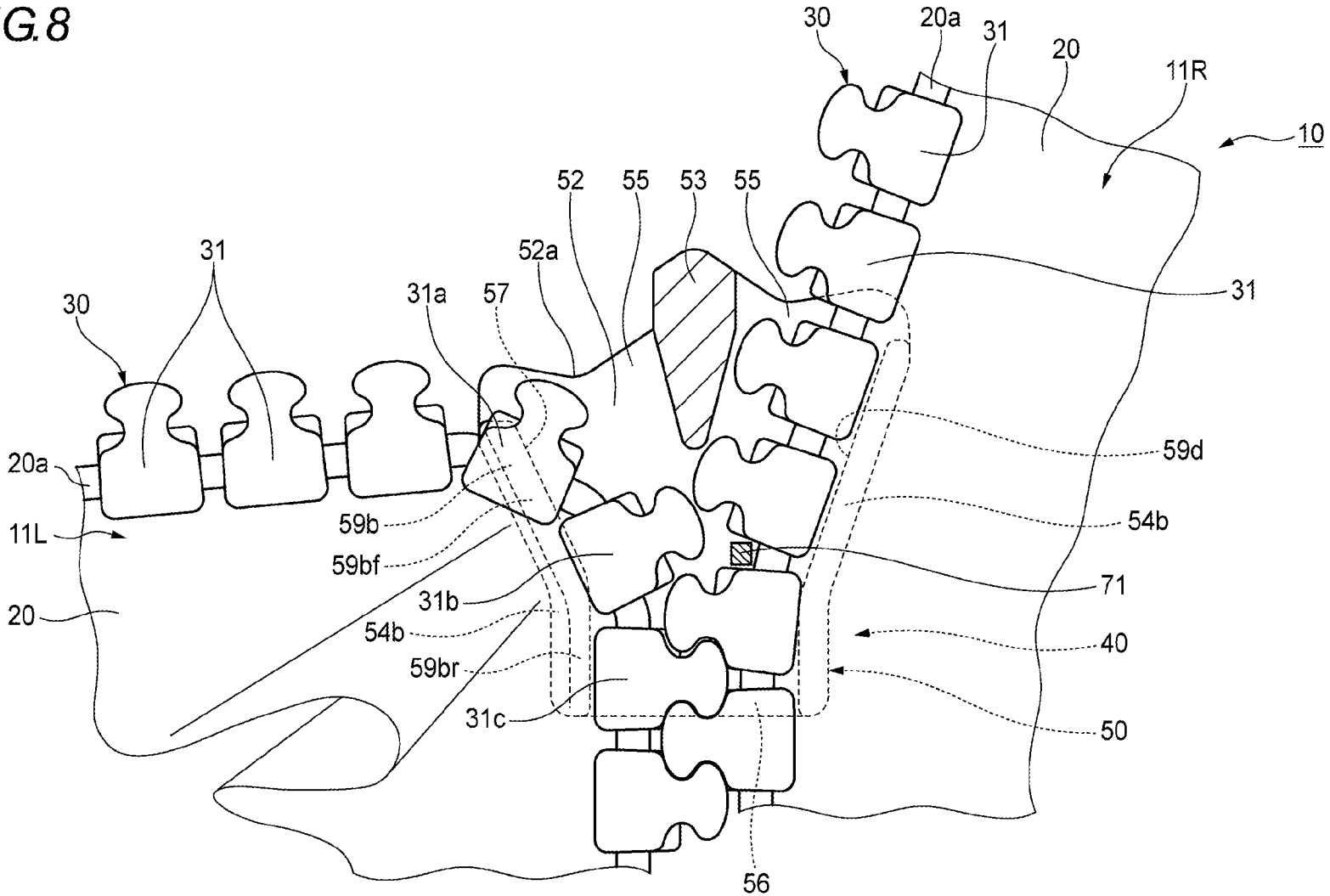
FIG. 8 is an enlarged front view illustrating a state in which elements of a separation-side fastener stringer shown in FIG. 7 start getting out of the slider.
Figure 9:
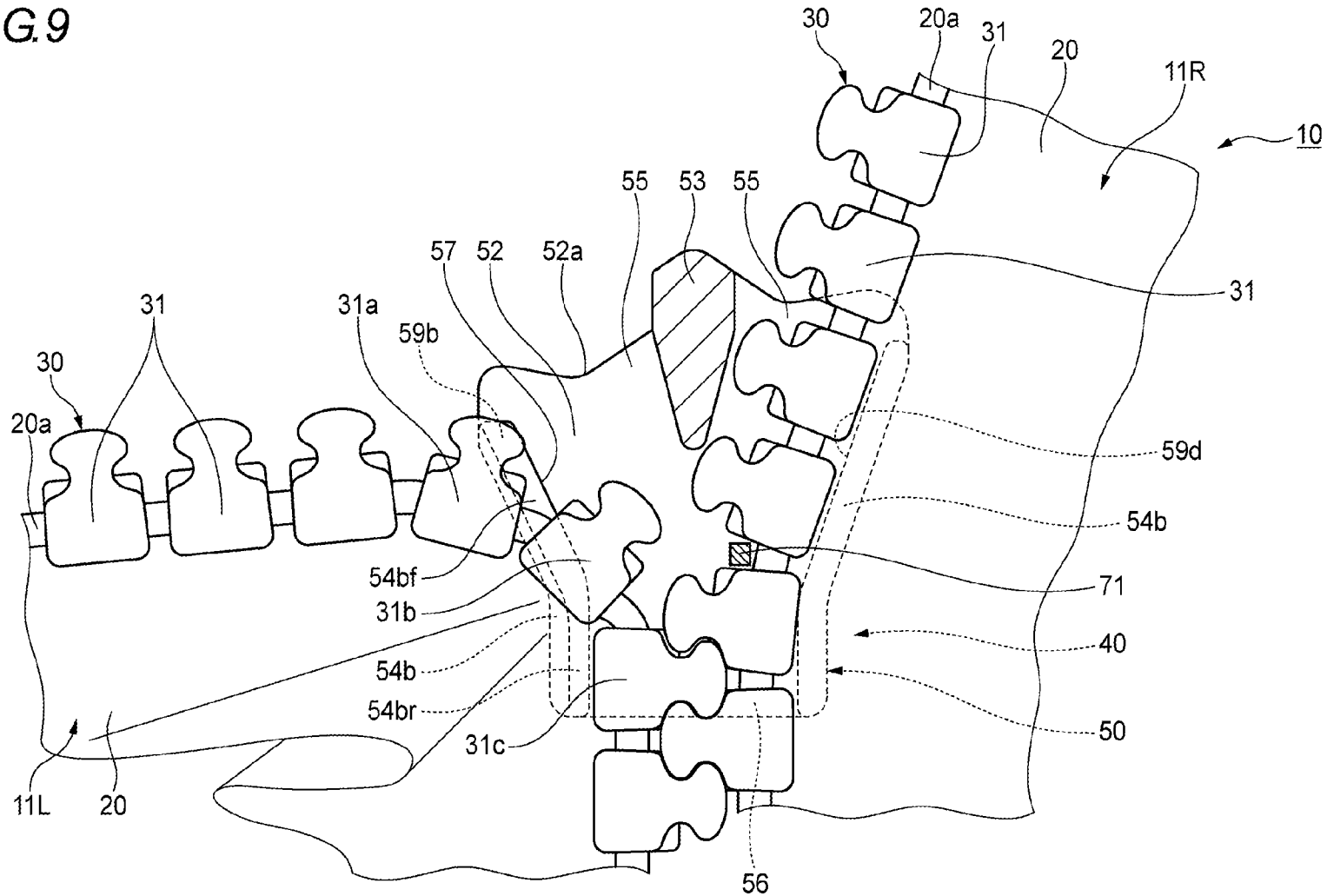
FIG. 9 is an enlarged front view illustrating a state in which the elements in FIG. 8 further get out of the slider.
Figure 10:
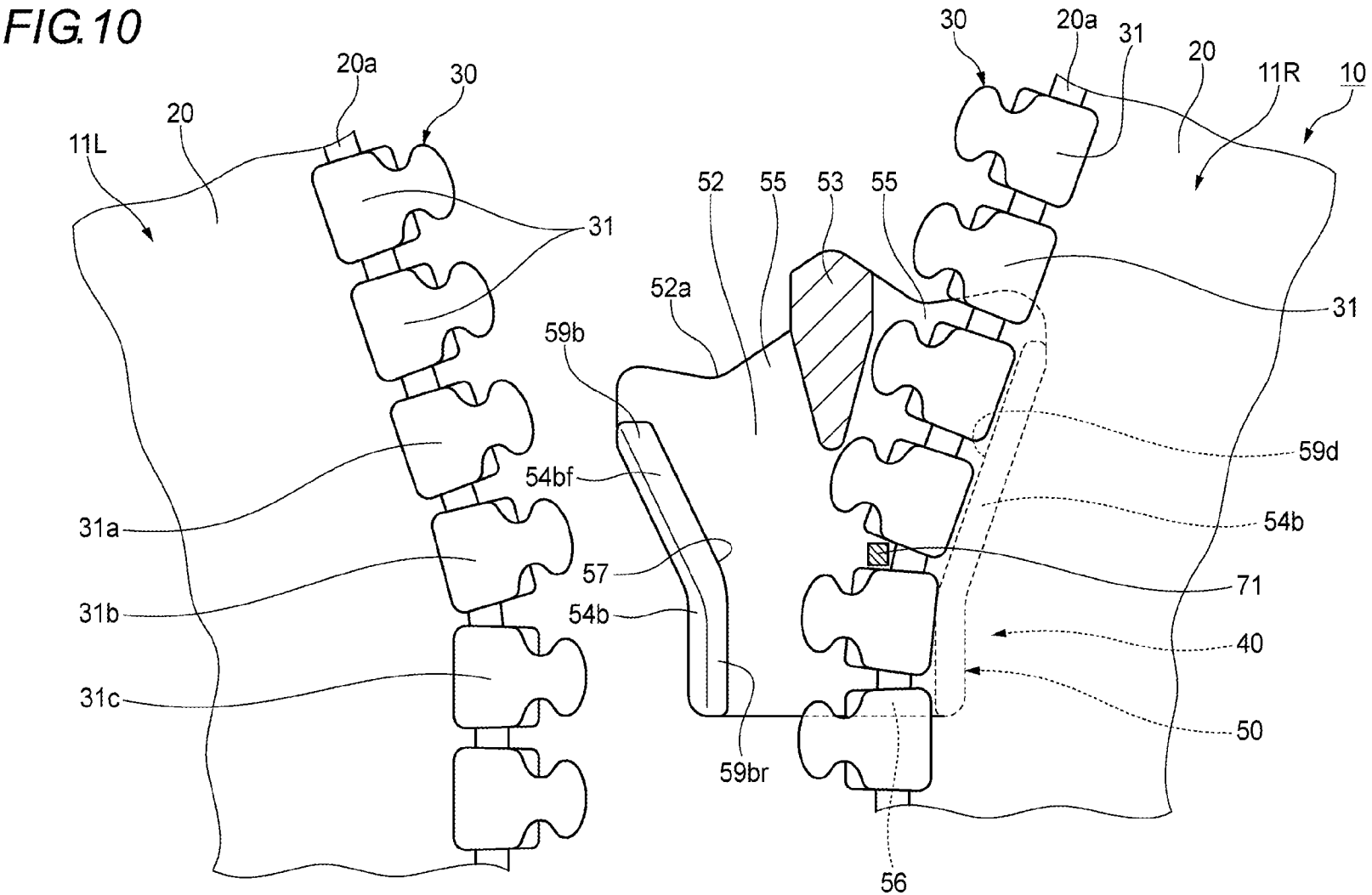
FIG. 10 is an enlarged front view illustrating a state in which the elements in FIG. 9 fully get out of the slider.
Figure 16:
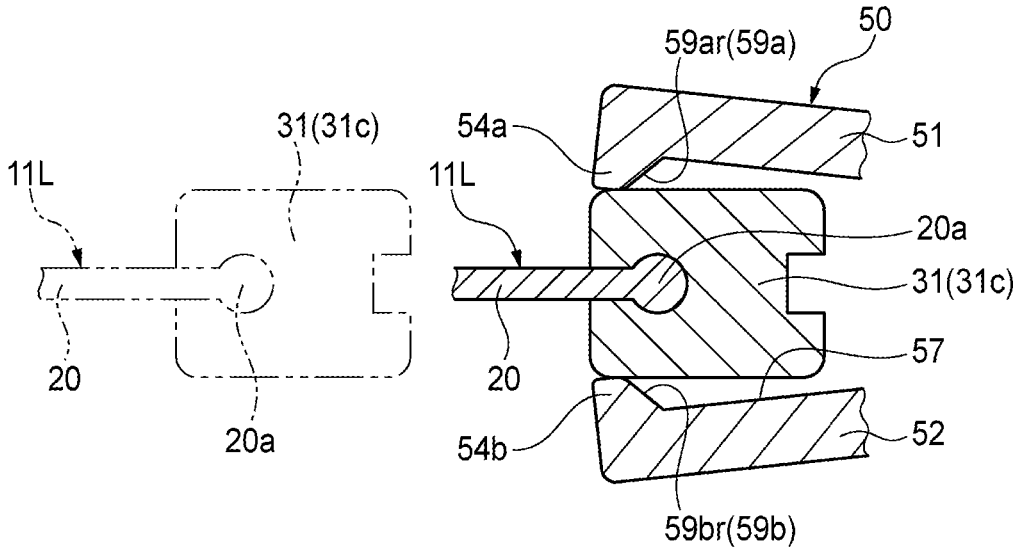
FIG. 16 is a partial cross-sectional view illustrating a state in which the element shown in FIG. 15 climbs over the rear inclined surface, and then gets out of the slider.

With the slide fastener 10 having the above configuration, as the lateral pulling force directed outward in the width direction is applied to the pair of left and right fastener stringers 11L and 11R (see FIG. 7), the first fastener element 31*a* (fastener element 31) of the separation-side fastener stringer 11L, which is positioned closest to the shoulder mouths 55 inside the element guide passage 57 and thus is not engaged, abuts against each of the front inclined surfaces 59*af* and 59*bf* of the upper and lower flanges 54*a* and 54*b* (see FIG. 11) to widen the gap between the upper and lower flanges 54*a* and 54*b*. Simultaneously, the first fastener element 31*a* bends the left portions of the upper blade 51 and lower blade 52 with respect to the guide post 53 (see FIGS. 8, 9, 12 and 13), so that the first fastener element gets out of the slider 40. The second fastener element 31*b* next to the first fastener element 31*a* gets out of the slider 40 in the same manner as the first fastener element 31*a*. Then, the third fastener element 31*c* next to the second fastener element 31*b* abuts against the rear inclined surfaces 59*ar* and 59*br* of the upper and lower flanges 54*a* and 54*b* (see FIG. 14) to widen the gap between the upper and lower flanges 54*a* and 54*b*. Simultaneously, the third fastener element 31*c* bends the left portion of the upper blade 51 and lower blade 52 with respect to the guide post 53 (see FIGS. 15 and 16), so that the third fastener element gets out of the slider 40. Accordingly, the first to third elements 31*a* to 31*c* climb over the upper and lower flanges 54*a* and 54*b*, and then sequentially get out of the slider 40, so that the separation-side fastener stringer 11L is separated from the slider 40 (see FIG. 10).

As described above, according to the slide fastener 10 of this embodiment, as the inner surfaces of the upper and lower flanges 54*a* and 54*b* at the left side of the body 50 in the width direction are formed as inclined surfaces 59*a* and 59*b* in which thicknesses of the inclined surfaces 59*a* and 59*b* gradually increase as the inclined surfaces 59*a* and 59*b* extend from an inside to an outside in the width direction, the fastener element 31 of the separation-side fastener stringer 11L abuts against the inclined surfaces 59*a* and 59*b* of the upper and lower flanges 54*a* and 54*b*, so that the lateral pulling force is efficiently transmitted to the upper blade 51 and lower blade 52 through the inclined surfaces 59*a* and 59*b*. Therefore, since the gap between the upper and lower flanges 54*a* and 54*b* is easily widened, it is possible to easily separate the separation-side fastener stringer 11L from the slider 40 with a simple structure.

Figure 17:
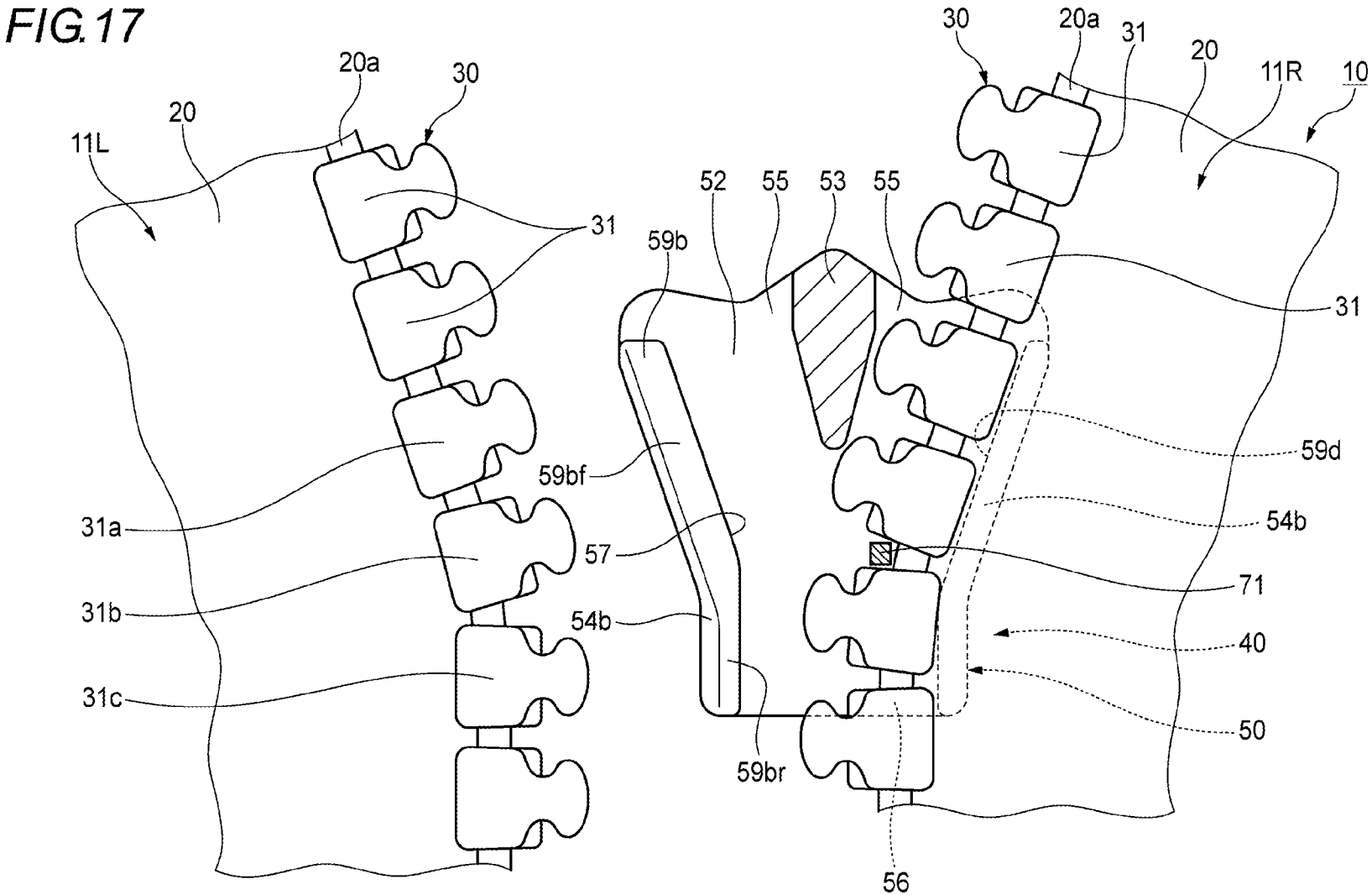
FIG. 17 is an enlarged front view corresponding to FIG. 10 to illustrate a modification of the slider fastener according to the present invention.

As a modification of the embodiment, as illustrated in FIG. 17, the upper blade 51 and the lower blade 52 may not be provided with the cutaway portions 51*a* and 52*a*. In this instance, the length of the upper and lower flanges 54*a* and 54*b* at the left side of the body 50 in the longitudinal direction are approximately equal to that of the upper and lower flanges 54*a* and 54*b* at the right side of the body 50.

Although the present invention is not limited to the above-described embodiment, and can be properly modified or revised without deviating from the gist of the present invention.

For example, the embodiment illustrates the case where the present invention is applied to the slider having the automatic stop function, but the present invention is not limited thereto. The present invention may be applied to a slider with no automatic stop function, in which a pull tab attachment post for attaching the pull tab 60 thereto is installed upright at the portions of the front attachment posts 58F and the rear attachment posts 58R, instead of the front and rear attachment posts.

Figure 18:
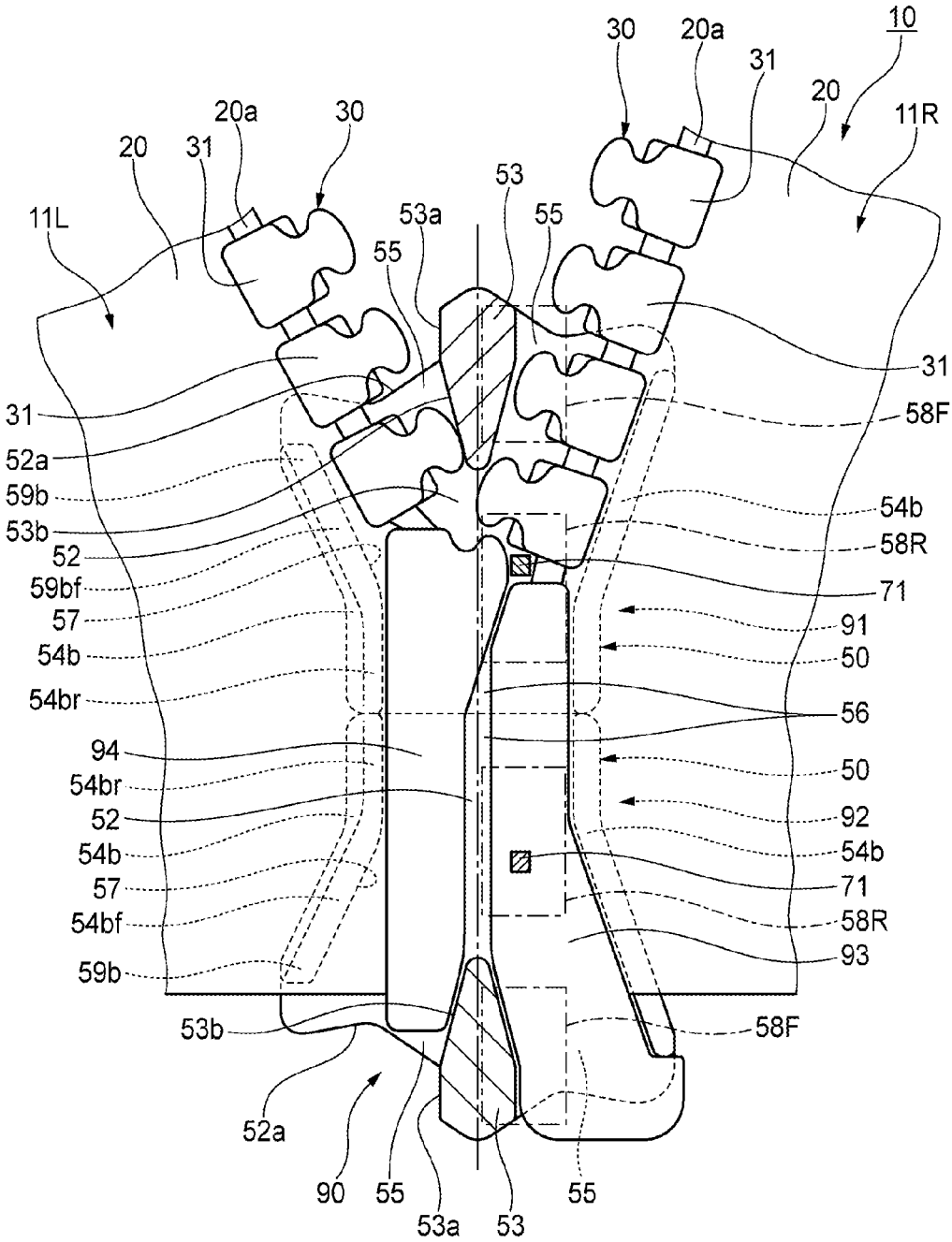
FIG. 18 is an enlarged front view of a state in which the upper blade is cut away, to illustrate a case where the present invention is applied to a slide fastener with a reverse separable end stop.

The embodiment illustrates that the separable end stop 13 are formed at the lower end portions of the pair of left and right fastener tapes 20, but the present invention is not limited thereto. As illustrated in FIG. 18, a reverse separable end stop 90 may be installed, instead of the separable end stop 13. The reverse separable end stop 90 includes an upper slider 91 having the same configuration as the slider 40, a lower slider 92 installed at a lower side of the upper slider 91 such that the rear mouths 56 face each other, a box pin 93 formed at the lower end portion of the tape-side edge 20*a* of the right fastener tape 20, and an insert pin 16 which is formed at the lower end portion of the tape-side edge 20*a* of the left fastener tape 20 and is able to be inserted into the upper slider 91 and the lower slider 92.

If the upper slider 91 is moved upward (in a direction away from the lower slider 92) in the reverse separable end stop 90, the pair of left and right fastener element rows 30 which are in the separated state are engaged with each other. If the upper slider 91 is moved downward (in a direction approaching the lower slider 92), the pair of left and right fastener element rows 30 which are in the engaged state are disengaged from each other. If the lower slider 92 is moved upward (in a direction approaching the upper slider 91), the pair of left and right fastener element rows 30 which are in the engaged state are disengaged from each other. If the lower slider 92 is moved downward (in a direction away from the upper slider 91), the pair of left and right fastener element rows 30 which are in the separated state are engaged with each other.

Comparing the lower slider 92 with the upper slider 91, when the front side of the lower slider 92 in the front and rear direction is set as the guide post 53, the cutaway portions 51*a* and 52*a*, the claw insertion hole 51*b*, the front and rear attachment posts 58F and 58R, the upper and lower flanges 54*a* and 54*b* having the short length in the front and rear direction, and the inclined surfaces 59*a* and 59*b* are disposed symmetrically in the left and right direction.

At both sides of the upper and lower sliders 91 and 92 in the reverse separable end stop 90, the fastener elements 31 are able to be separated from the gap between the upper and lower flanges 54*a* and 54*b* at the side (at the side of separation-side fastener stringer 11L) in which the insert pin 94 is inserted.

DESCRIPTION OF REFERENCE NUMERALS

11L: Fastener Stringer (Separation-Side Fastener Stringer)
11R: Fastener Stringer (Stationary-Side Fastener Stringer)
20: Fastener Tape
20*a*: Tape-Side Edge
30: Fastener Element Row
31: Fastener Element
40: Slider
50: Body
51: Upper Blade
51*a*: Cutaway Portion
52: Lower Blade
52*a*: Cutaway Portion
53: Guide Post
53*a*: Front Lateral Surface
54*a*: Upper Flange
54*b*: Lower Flange
58F: Front Attachment Post (Pull Tab Attachment Portion)
58R: Rear Attachment Post (Pull Tab Attachment Portion)
59*a*: Inclined Surface
59*af*: Front Inclined Surface
59*ar*: Rear Inclined Surface
59*b*: Inclined Surface
59*bf*: Front Inclined Surface
59*br*: Rear Inclined Surface
59*c*: Vertical Surface
59*d*: Vertical Surface
60: Pull Tab
80: Pull Tab Holding Cover (Pull Tab Attachment Portion)
α: Inclined Angle of Front Inclined Surface
β: Inclined Angle of Rear Inclined Surface

The invention claimed is:

1. A slide fastener comprising:

a pair of fastener stringers provided with fastener element rows having a plurality of fastener elements along opposing tape-side edges of a pair of fastener tapes; and a slider slidably attached to the fastener element rows to engage and disengage the fastener elements, wherein one of the fastener stringers is separated from the slider when a lateral pulling force directed outward in a width direction of the fastener tapes is applied to the pair of fastener stringers, wherein the slider includes:

a body having an upper blade and a lower blade which are disposed in parallel while being spaced apart from each other in an up-down direction, a guide post connecting the upper blade and the lower blade at front ends thereof, an upper flange protruding downwardly along both left and right edges of the upper blade, a lower flange protruding upwardly along both left and right edges of the lower blade, and a pull tab attachment portion provided on an upper surface of the upper blade; and a pull tab rotatably attached to the pull tab attachment portion, wherein inner surfaces of the upper and lower flanges at one side of the body in the width direction are formed as inclined surfaces in which thicknesses of the inclined surfaces gradually increase as the inclined surfaces extend from an inside to an outside in the width direction; and wherein a dimension of a gap between the upper and lower flanges in the up-down direction at the one side of the body in the width direction is larger than a dimension of a gap between the upper and lower flanges in the up-down direction at another side of the body in the width direction.

2. The slide fastener according to claim 1, wherein inner surfaces of the upper and lower flanges at the another side of the body in the width direction respectively have vertical surfaces which extend vertically to inner surfaces of the upper blade and the lower blade in the up-down direction.

3. A slide fastener comprising:

a pair of fastener stringers provided with fastener element rows having a plurality of fastener elements along opposing tape-side edges of a pair of fastener tapes; and a slider slidably attached to the fastener element rows to engage and disengage the fastener elements, wherein one of the fastener stringers is separated from the slider when a lateral pulling force directed outward in a width direction of the fastener tapes is applied to the pair of fastener stringers, wherein the slider includes:

a body having an upper blade and a lower blade which are disposed in parallel while being spaced apart from each other in an up-down direction, a guide post connecting the upper blade and the lower blade at front ends thereof, an upper flange protruding downwardly along both left and right edges of the upper blade, a lower flange protruding upwardly along both left and right edges of the lower blade, and a pull tab attachment portion provided on an upper surface of the upper blade; and a pull tab rotatably attached to the pull tab attached portion, wherein inner surfaces of the upper and lower flanges at one side of the body in the width direction are formed as inclined surfaces in which thicknesses of the inclined surfaces gradually increase as the inclined surfaces extend from an inside to an outside in the width direction, wherein the inclined surfaces respectively have front inclined surfaces formed at a side of shoulder mouths of the body, and rear inclined surfaces formed at a side of a rear mouth of the body, and wherein an inclined angle of the front inclined surfaces is smaller than an inclined angle of the rear inclined surfaces.

4. A slide fastener comprising:

a pair of fastener stringers provided with fastener element rows having a plurality of fastener elements along opposing tape-side edges of a pair of fastener tapes; and a slider slidably attached to the fastener element rows to engage and disengage the fastener elements, wherein one of the fastener stringers is separated from the slider when a lateral pulling force directed outward in a width direction of the fastener tapes is applied to the pair of fastener stringers, wherein the slider includes:

a body having an upper blade and a lower blade which are disposed in parallel while being spaced apart from each other in an up-down direction, a guide post connecting the upper blade and the lower blade at front ends thereof, an upper flange protruding downwardly along both left and right edges of the upper blade, a lower flange protruding upwardly along both left and right edges of the lower blade, and a pull tab attachment portion provided on an upper surface of the upper blade; and a pull tab rotatably attached to the pull tab attachment portion, wherein inner surfaces of the upper and lower flanges at one side of the body in the width direction respectively have inclined surfaces in which thicknesses of the inclined surfaces gradually increase as the inclined surfaces extend from an inside to an outside in the width direction, wherein inner surfaces of the upper and lower flanges at another side of the body in the width direction respectively have vertical surfaces which extend vertically to inner surfaces of the upper blade and lower blade in the up-down direction, wherein the inclined surfaces are formed continuously from front ends of the upper and lower flanges to rear ends of the upper and lower flanges at the one side of the body in the width direction, and wherein the vertical surfaces are formed continuously from front ends of the upper and lower flanges to rear ends of the upper and lower flanges at the another side of the body in the width direction.

* * * * *

UNITED STATES PATENT AND TRADEMARK OFFICE

CERTIFICATE OF CORRECTION

PATENT NO. : 8,720,015 B2
APPLICATION NO. : 13/816245
DATED : May 13, 2014
INVENTOR(S) : Hideki Sato It is certified that error appears in the above-identified patent and that said Letters Patent is hereby corrected as shown below:

Title Page

Item (57), in column 2, under "Abstract", line 5, delete "engage an" and insert -- engage and --, therefor.

In the Specification

In column 4, line 48, delete "the a" and insert -- the --, therefor.

Signed and Sealed this
Fifth Day of August, 2014

Michelle K. Lee

Michelle K. Lee
*Deputy Director of the United States Patent and Trademark Office*